US011795416B2

(12) United States Patent
Bernard et al.

(10) Patent No.: US 11,795,416 B2
(45) Date of Patent: Oct. 24, 2023

(54) SYNERGISTIC EFFECTS OF IMINODISUCCINIC ACID ON AN ETHANOL AND PEG400 BLEND FOR RHEOLOGY CONTROL

(71) Applicant: Henkel IP & Holding GmbH, Duesseldorf (DE)

(72) Inventors: Andrew Neal Bernard, East Lyme, CT (US); Wei Sun, Trumbull, CT (US); Aaron Matthew Schwartz, Trumbull, CT (US); Napaporn Slattery, Monroe, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 110 days.

(21) Appl. No.: 17/249,023

(22) Filed: Feb. 17, 2021

(65) Prior Publication Data

US 2022/0259522 A1 Aug. 18, 2022

(51) Int. Cl.

| | |
|---|---|
| ***C11D 3/33*** | (2006.01) |
| ***C11D 3/20*** | (2006.01) |
| ***C11D 3/37*** | (2006.01) |
| ***C11D 17/08*** | (2006.01) |
| ***C11D 1/29*** | (2006.01) |
| ***C11D 1/722*** | (2006.01) |

(52) U.S. Cl.

CPC ..... *C11D 3/33* (2013.01); *C11D 1/29* (2013.01); *C11D 1/722* (2013.01); *C11D 3/201* (2013.01); *C11D 3/2065* (2013.01); *C11D 3/3707* (2013.01); *C11D 3/3723* (2013.01); *C11D 17/08* (2013.01)

(58) Field of Classification Search

CPC ..... C11D 3/33; C11D 3/201; C11D 3/3707; C11D 1/29

See application file for complete search history.

(56) References Cited

U.S. PATENT DOCUMENTS

| | | | | |
|---|---|---|---|---|
| 5,977,053 | A * | 11/1999 | Groth | C11D 3/33 510/501 |
| 6,482,792 | B2 | 11/2002 | Ip | |
| 6,566,317 | B2 | 5/2003 | Morris et al. | |
| 10,047,328 | B2 * | 8/2018 | Naqvi | C11D 1/29 |
| 10,745,654 | B2 * | 8/2020 | Naqvi | C11D 3/2065 |
| 2010/0081600 | A1 * | 4/2010 | Boutique | C11D 3/40 510/276 |
| 2015/0093425 | A1 * | 4/2015 | Moore | C11D 11/0041 424/408 |
| 2015/0329807 | A1 * | 11/2015 | Naqvi | C11D 17/043 206/524.7 |
| 2018/0312788 | A1 * | 11/2018 | Naqvi | C11D 1/94 |
| 2019/0169118 | A1 * | 6/2019 | Piorkowski | C11D 3/2006 |
| 2019/0169535 | A1 * | 6/2019 | Piorkowski | C11D 1/29 |
| 2019/0233768 | A1 * | 8/2019 | Piorkowski | C11D 1/83 |
| 2019/0270952 | A1 * | 9/2019 | Piorkowski | C11D 1/38 |
| 2019/0270953 | A1 * | 9/2019 | Piorkowski | C11D 3/43 |
| 2020/0002655 | A1 * | 1/2020 | Piorkowski | C11D 3/30 |
| 2020/0199491 | A1 * | 6/2020 | Piorkowski | C11D 3/3707 |
| 2020/0199497 | A1 * | 6/2020 | Piorkowski | C11D 1/62 |
| 2021/0054305 | A1 * | 2/2021 | Sun | C11D 11/0017 |
| 2022/0259522 | A1 * | 8/2022 | Bernard | C11D 3/3707 |

FOREIGN PATENT DOCUMENTS

| | | | | |
|---|---|---|---|---|
| EP | 2169040 | A1 * | 3/2010 | C11D 17/0013 |
| EP | 3647398 | A1 * | 5/2020 | C11D 1/66 |
| EP | 3889242 | A1 * | 10/2021 | C11D 1/66 |

OTHER PUBLICATIONS

European Patent Office, European Search Report, EP 22156991, dated Jun. 21, 2022, pp. 1-8, Munich, Germany.

Sun et al, "Single Dose Detergent Packs With A Combination Of Non-Aqueous Solvents", U.S. Appl. No. 16/837,484, filed Apr. 1, 2020, United States of America.

* cited by examiner

*Primary Examiner* — Liam J Heincer
*Assistant Examiner* — M. Reza Asdjodi
(74) *Attorney, Agent, or Firm* — Bojuan Deng

(57) ABSTRACT

A method for controlling rheology of a unit dose liquid detergent composition includes providing a detergent composition containing less than 20% water, a detergent surfactant, and a rheology modification system comprising iminodisuccinic acid (IDS), ethanol, and polyethylene glycol having a molecular weight of 200 to 1,000 Daltons; and encapsulating the detergent composition in a pouch made of a water soluble film. The viscosity of a mixture of 2 parts of a low water detergent composition to 1 part water can be maintained below 1,000 cp at 1.08 reciprocal seconds where the detergent composition includes about 1% to about 10% by weight of a mixture of IDS, ethanol, and polyethylene glycol having a molecular weight of 200 to 1,000 Daltons.

17 Claims, No Drawings

SYNERGISTIC EFFECTS OF IMINODISUCCINIC ACID ON AN ETHANOL AND PEG400 BLEND FOR RHEOLOGY CONTROL

FIELD OF THE INVENTION

The present disclosure relates to unit dose laundry pacs. In particular, the present disclosure relates to use of a combination of iminodisuccinic acid, ethanol, and polyethylene glycol to control the rheology of liquid detergent formulations contained in a unit dose laundry pac.

BACKGROUND OF THE INVENTION

Water-soluble unit dose laundry pacs are becoming increasingly popular due to their convenience and ease of use. They eliminate messiness, spillage, and dosing confusion that consumers may encounter using liquid laundry detergents. However, to provide similar cleaning power as a standard liquid laundry detergent unit in the smaller sized laundry pac, the detergent components of unit dose pacs are much more concentrated than traditional liquid detergent, and, in particular, contain a higher total surfactant concentration. While the higher concentration of surfactants is beneficial for packaging, transportation, and storage efficiency, it can cause issues with the physical stability of the pac and rheology control of the detergent liquid within the laundry pac.

It is desirable that the liquid detergent composition not be excessively viscous when diluted in water, such that it dissolves completely when exposed to wash water, thereby ensuring a complete dispersion of the liquid throughout the laundry load so that the detergent is fully available for its intended washing use, and further assuring that the detergent liquid is cleanly distributed within the washing machine without causing any build-up or clogging of any internal passages, tubes or pipes of the washing machine. In general, water-diluted viscosities, at dilution ratios of 2:1 (detergent composition to water) or greater dilution, of less than about 1,000 centipoise (at 25° C.) are suitable for the liquid composition of a single dose pack. Therefore, a single dose pac liquid detergent composition usually includes non-aqueous solvents in order provide a suitable viscosity. However, increasing the use of non-aqueous solvents undesirably reduces the volume available for other components of the liquid detergent composition, such as additional surfactant, and further increases its expense.

It is still a challenge today to find an optimal composition for liquid detergents in unit dose laundry pacs that provides good dissolution of the product, which translates into performance in-wash as well as prevents any issues such as clogging. Compounding these challenges is that many consumers desire the physical properties of previous generation liquid detergents to be maintained in the newer unit dose pacs.

Rheology is a useful metric of the flow of matter used by formulations for various purposes. Rheology modification can help in creating a safe, aesthetic product for the consumer all while making it easy to produce and handle with regards to processing. There is a desire to provide a solution to the rheology issue that arises when trying to utilize traditional liquid detergents in the unit dose presentation.

Proposed solutions for dealing with the issue of physical stability and rheology control of the laundry pac include implementing a higher concentration of non-aqueous solvent. However, there is still a need for an optimal composition that ensures good dissolution of the product.

US 2019/0169118 discloses a method for modifying the rheology of polyethoxylated alcohol sulfate surfactant, such as sodium laureth ether sulfate (SLES), using a polyol and a mono-alcohol.

Similarly, US 2019/0169535 discloses a method for modifying the rheology of polyethoxylated alcohol sulfate surfactants, such as SLES, with an ionic liquid and alcohol blend. The ionic liquid can be trioctyl methyl amine dioctyl sulfosuccinate, triisooctyl methyl amine C12-C13 methyl branched dodecyl sulfate, tetraoctyl amine dodecyl sulfate, N-dodecyl-N,N-dimethyl-N-hydroxyammonium dodecyleethoxysulfate, N-(dodecylamindopropyl)-N, N-dimethyl-N-carboxymethylammonium, N-(dodecylamindopropyl)-N, N-dimethyl-N-carboxymethylammonium, tris(2-hydroxyethyl) methyl-ammonium methylsulfate, and a mixture thereof. Preferably, the ionic liquid is tris(2-hydroxyethyl) methyl-ammonium methylsulfate.

There remains a need for improving the physical stability and rheology of water-soluble formulations contained in unit dose laundry packs. In particular, there remains a need to improve the viscosity of a composition containing a higher surfactant concentration and lower amounts of water than traditional laundry compositions. Specifically, there is a need for improving the rheology of surfactant systems that contain ionic surfactants and nonionic surfactants. There is particularly a need for modifying the viscosity of detergents having a surfactant system containing an alkyl ether sulfonate, a linear alkylbenzene sulfonate, and a fatty alcohol ethoxylate.

SUMMARY OF THE INVENTION

The present disclosure provides a synergistic combination of iminodisuccinic acid, ethanol, and polyethylene glycol having molecular weight in the range from about 200 to about 1,000 Daltons that can modify, and in particular, reduce, the viscosity of liquid detergents and liquid detergent platforms to deliver a laundry detergent in a unit dose pac that has a viscosity that provides desired flowability and dispersion.

Experimental data generated by the inventors show that a synergistic effect of the combination of iminodisuccinic acid, polyethylene glycol and an alcohol is the reduction of product viscosity in a low water detergent composition that is greater than the expected sum of the effects of each component when used individually.

In one aspect, the present invention provides a method for controlling rheology of a unit dose liquid detergent composition by providing a detergent composition comprising less than 20% water, a detergent surfactant, and a rheology modification system comprising iminodisuccinic acid (IDS), ethanol, and polyethylene glycol having a molecular weight of 200 to 1,000 Daltons; and encapsulating the detergent composition in a pouch made of a water soluble film.

In preferred embodiments, the viscosity of a mixture of 2 parts of the detergent composition to 1 part water is maintained below 1,000 cp at 1.08 reciprocal seconds.

According to some embodiments, the detergent composition consists essentially of less than 20% water, a detergent surfactant, and a rheology modification system consisting essentially of iminodisuccinic acid (IDS), ethanol, and polyethylene glycol having a molecular weight of 200 to 1,000 Daltons and, optionally, alkoxylated polyamine, such as PEI-PO.

In other embodiments, the detergent composition consists of less than 20% water, detergent surfactant, and the rheology modification system.

In a second aspect, the invention provides a liquid detergent composition for a unit dose pac comprising: less than 20% water, detergent surfactant, and a rheology modification system comprising iminodisuccinic acid (IDS), ethanol, and polyethylene glycol having a molecular weight of 200 to 1,000 Daltons, wherein viscosity of the detergent composition is less than 1 Pa·s (1,000 cP) at 1.08 reciprocal seconds.

According to some embodiments, the detergent composition consists essentially of less than 20% water, detergent surfactant, and the rheology modification system.

In other embodiments, the detergent composition consists of less than 20% water, detergent surfactant, and the rheology modification system.

In some embodiments, the detergent surfactant comprises an alkyl ether sulfonate, a linear alkylbenzene sulfonate, and a fatty alcohol ethoxylate.

In some embodiments, the rheology modification system comprises about 1 to about 10 percent by weight of the detergent composition. In some of those embodiments, the rheology modification system comprises about 2 to about 8 percent by weight of the detergent composition. In certain of those embodiments, the rheology modification system comprises about 5 to about 7 percent by weight of the detergent composition.

In certain embodiments, IDS comprises about 0.1% to about 1.0% by weight of the detergent composition. In certain of those embodiments, IDS comprises about 0.1% to about 0.5% by weight of the detergent composition. In other of those embodiments, IDS comprises about 0.2% to about 0.4% by weight of the detergent composition. In certain preferred embodiments, IDS comprises about 0.2%, or about 0.33% by weight of the detergent composition.

In some embodiments, the rheology modification system consists essentially of iminodisuccinic acid (IDS), polyethylene glycol having a molecular weight of 200 to 1,000 Daltons, and ethanol. In some of those embodiments, the polyethylene glycol has a molecular weight of about 400 Daltons (PEG400).

In certain embodiments, the rheology modification system consists of iminodisuccinic acid (IDS), ethanol, and polyethylene glycol having a molecular weight of 200 to 1,000 Daltons. In certain of those embodiments, the polyethylene glycol has a molecular weight of about 400 Daltons (PEG400).

In some embodiments, the ratio of ethanol to polyethylene glycol in the detergent composition is at least about 1:1. In some of those embodiments, the ratio of ethanol to polyethylene glycol is about 1:1 to about 3:1. In certain preferred embodiments, the ratio of ethanol to polyethylene glycol is about 1.5:1.

In certain embodiments, the rheology modification system further comprises an alkoxylated polyamine, preferably an alkoxylated polyethyleneimine, most preferably a polyethyleneimine-ethoxylated polymer (PEI-PO).

In some embodiments, the alkoxylated polyethyleneimine rheology control agent is about 0 to about 5.0 wt. % of the detergent composition, preferably, about 0.4 to about 4.7 wt. % of the detergent composition, more preferably about 1.2 to about 4.7 wt. % of the detergent composition, and most preferably about 1.2 to about 3.5 wt. % of the detergent composition.

In some embodiments, the rheology modification system consists essentially of iminodisuccinic acid (IDS), ethanol, polyethylene glycol having a molecular weight of 200 to 1,000 Daltons, and an alkoxylated polyamine. In some of those embodiments, the polyethylene glycol has a molecular weight of about 400 Daltons (PEG400) and the alkoxylated polyamine is a polyethyleneimine-ethoxylated polymer.

In certain embodiments, the rheology modification system consists of iminodisuccinic acid (IDS), ethanol, polyethylene glycol having a molecular weight of 200 to 1,000 Daltons, and an alkoxylated polyamine. In certain of those embodiments, the polyethylene glycol has a molecular weight of about 400 Daltons (PEG400) and the alkoxylated polyamine is a polyethyleneimine-ethoxylated polymer.

In certain embodiments, the detergent composition further comprises a component selected from a group consisting of: a C2 to C5 polyol, a C2 to C5 alkanolamine, an active enzyme, a whitening agent, a bittering agent, a linear alkylbenzene sulfonate, alkyl-ether sulfates, a fatty alcohol ethoxylate, and combinations thereof.

Thus, according to some embodiments, the detergent composition may consist essentially of: less than 20% water, detergent surfactant, the rheology modification system, and one more components selected from a group consisting of: C2 to C5 polyols, C2 to C5 alkanolamines, active enzymes, whitening agents, and bittering agents.

In some embodiments, the detergent composition consists of less than 20% water, detergent surfactant, the rheology modification system, C2 to C5 polyol, C2 to C5 alkanolamine, active enzyme, whitening agent, and bittering agent.

In certain embodiments, the C2 to C5 polyol is glycerine. In some of those embodiments, the glycerine is about 5% to about 15%, more preferably about 8% to about 12% or 10% to about 15%, most preferably about 10% to about 15% by weight of the detergent composition. In other embodiments, the C2 to C5 polyol is a mixture of glycerine and propylene glycol and the amount of C2 to C5 polyol is about 10% to about 20% by weight of the detergent composition.

In some embodiments, the alkyl-ether sulfate, the linear alkyl benzene sulfonate, and the fatty alcohol ethoxylate detergent surfactants are present in a weight ratio of (2 to 5):1:(3 to 10) in the composition.

In certain embodiments, the alkyl-ether sulfate has a C12 alkyl chain.

In a third aspect, the invention provides a unit dose detergent composition comprising a unit dose pouch comprising water soluble film, a detergent composition encapsulated in the unit dose pouch, wherein the detergent composition comprises less than 20% water, about 30 to about 70 percent by weight detergent surfactant, and about 1 to about 10 percent by weight of a rheology modification system comprising iminodisuccinic acid (IDS), ethanol, and polyethylene glycol having a molecular weight of 200 to 1,000 Daltons.

In certain preferred embodiments, the detergent surfactant comprises an alkyl ether sulfonate, a linear alkylbenzene sulfonate, and a fatty alcohol ethoxylate.

According to some embodiments, the detergent composition comprises a rheology modification system consisting essentially of iminodisuccinic acid (IDS), ethanol, and polyethylene glycol having a molecular weight of 200 to 1,000 Daltons.

In other embodiments, the detergent composition comprises a rheology modification system consisting of iminodisuccinic acid (IDS), ethanol, and polyethylene glycol having a molecular weight of 200 to 1,000 Daltons.

In some preferred embodiments, the detergent composition further comprises an alkoxylated polyamine, such as a PEI-PO.

According to some embodiments, the detergent composition comprises a rheology modification system consisting essentially of iminodisuccinic acid (IDS), ethanol, polyethylene glycol having a molecular weight of 200 to 1,000 Daltons, and an alkoxylated polyamine, such as a PEI-PO.

In other embodiments, the detergent composition comprises a rheology modification system consisting of iminodisuccinic acid (IDS), ethanol, polyethylene glycol having a molecular weight of 200 to 1,000 Daltons, and alkoxylated polyamine, such as a PEI-PO.

According to some embodiments, the detergent composition encapsulated in the unit dose pouch consists essentially of less than 20% water, about 30 to about 70 percent by weight detergent surfactant, and about 1 to about 10 percent by weight of the rheology modification system. In some of those embodiments, the detergent composition further comprises alkoxylated polyamine, such as a PEI-PO.

In some preferred embodiments, the detergent composition further comprises glycerine and/or propylene glycol. Thus, the detergent composition may consist essentially of less than 20% water, about 30 to about 70 percent by weight detergent surfactant, glycerine and/or propylene glycol, and about 1 to about 10 percent by weight of the rheology modification system. In some of those embodiments, the detergent composition further comprises alkoxylated polyamine, such as a PEI-PO.

In certain embodiments, the unit dose detergent composition further comprises one or more additional components selected from the group consisting of: enzymes, peroxy compounds, bleach activators, anti-redeposition agents, neutralizers, optical brighteners, foam inhibitors, chelators, buttering agents, dye transfer inhibitors, soil release agents, water softeners, electrolytes, pH regulators, graying inhibitors, anti-crease components, bleach agents, colorants, scents, processing aids, antimicrobial agents, and preservatives.

Therefore, according to some embodiments, the detergent composition encapsulated in the unit dose pouch consists essentially of/consists of less than 20% water, about 30 to about 70 percent by weight detergent surfactant, about 1 to about 10 percent by weight of the rheology modification system, glycerine and/or propylene glycol, and one or more additional components selected from the group consisting of: enzymes, peroxy compounds, bleach activators, anti-redeposition agents, neutralizers, optical brighteners, foam inhibitors, chelators, buttering agents, dye transfer inhibitors, soil release agents, water softeners, electrolytes, pH regulators, graying inhibitors, anti-crease components, bleach agents, colorants, scents, processing aids, antimicrobial agents, and preservatives. In some of those embodiments, the detergent composition further comprises alkoxylated polyamine, such as a PEI-PO.

In some embodiments, the water-soluble film comprises a polyvinyl alcohol (PVOH).

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The compositions described herein comprise solvent systems that are able to control viscosity and provide improved rheology of liquid detergent compositions suitable for unit dose pacs.

The terms "container", "pouch", "pack", "pac", "unit dose", and "single dose" can be used interchangeably and can have one or two or multi-compartments (i.e., multi chamber).

The terms "blend(s)" and "composition(s)" are used interchangeably.

The terms "solvent," "solvents," and "solvent system," mean a liquid or liquids used to dissolve or solvate other chemicals. In some cases, materials can also be dispersed within the solvent (i.e., Titanium Dioxide in water). In other cases, a solvent (i.e., solvent A) can initially exist as a solid and then be dissolved within solvent B, so solvent A can then act as a solvent itself (i.e., PEG 3350 in water). As used herein, the terms "solvent," "solvents," and "solvent system," do not include neutralization agents, such as, e.g., triethanolamine, monoethanolamine, and sodium Hydroxide.

The term "about" includes the recited number ±10%. For example, "about 10" means 9 to 11.

As used herein, the "%" described in the present invention refers to the weight percentage unless otherwise indicated. Absent explicit statement to the contrary, wt. % in the specification refers to the weight percentage of an ingredient as compared to the total weight of the detergent composition. Accordingly, the calculation of wt. % for a detergent composition or an ingredient thereof does not include, for example, the weight of the film. For example, the wt. % of surfactant refers to the weight percentage of the total active surfactant in the composition. The wt. % of the total water in the liquid composition is calculated based on all the water including those added as a part of individual ingredients. When an ingredient added to make the liquid composition is not 100% pure and used as a mixture, e.g., in a form of a solution, the wt. % of that material added refers to the weight percentage of the mixture. Thus, a component which is 5 wt. % of the formulation, may be added as 5 wt. % of a pure component or 10 wt. % of solution that is 50% component and 50% water. Either result produces the recited 5 wt. % amount of the component in the resulting formulation. All percentages presented in this specification and the associated claims are weight percentages unless explicitly identified otherwise. Mole fractions and volume fractions are not used unless explicitly identified.

Unless stated otherwise, molecular weight of a polymer refers to weight average molecular weight.

The phrase "substantially free of" means that a composition contains little to no specified ingredient/component, such as less than about 1 wt. %, 0.5 wt. %, or 0.1 wt. %, or below the detectable level of the specified. For example, the phrase "substantially free of a sulphate surfactant" refers to a liquid composition of the present invention that contains little or no sulphate surfactant.

The term "an improved rheology" used herein refers to a reduced viscosity level of the detergent composition. An improved rheology allows the detergent composition to be reasonably flowable and processable during manufacturing processes.

In accordance with the invention, an improved rheology is achieved by a solvent system comprising rheology control agents.

A rheology control agent is a water soluble material which reduces the free water in the unit-dose detergent composition. By reducing the free water, rheology control agents are normally associated with increasing the viscosity of solutions. However, it appears that the rheology control agents' reduction in free energy of the water in the formulation facilitates dilution of the detergent composition with water. Preferred rheology control agents appear to have a polarity less than that of water so as to provide additional stability between the water than the other components of the detergent composition. The rheology control agent provides a reduced free energy of the water in the formulation. This reduced free energy in turn, may reduce the tendency to phase separate and facilitate dilution. The rheology control agent can be thought of as stabilizing (by reducing the energy of) the water in the formulation during dilution. Thus, a wide variety of materials may function as rheology control agents based on their ability to reduce the free energy of the water in the detergent composition and their ability to continue to perform this stabilization as water is added to the formulation.

The invention will now be described in detail.

The detergent composition described exists as a liquid in the unit-dose packet. The detergent composition is formulated to be shelf stable, for example, not to undergo unexpected and/or determination changes during shipping, storage, etc. prior to use. In some embodiments, the detergent composition is substantially free of solids. The detergent composition may be substantially free of precipitates. The detergent composition may remain free of precipitates and/or other solids during storage and/or environmental testing conditions to simulate storage.

The detergent composition disperses into the wash liquid. The dilution from the detergent composition to the concentration in the wash liquid may be substantial, for example, over multiple orders of magnitude. A variety of factors encourage the use of smaller unit dose detergent composition packages, including storage size, cost of the film used to contain the unit dose, etc. Generally speaking, consumers may prefer smaller detergent composition dose formulations as convenient and storable. Because the goal is to deliver the same amount of detergent compositions and other active components, many unit dose detergent compositions include lower concentrations of solvents, such as water. Unit dose detergent compositions may also use other solvents and/or mixtures of solvents to increase the storage stability of the water soluble film in contact with the detergent composition.

Accordingly, the detergent composition is stable in its concentrated composition and at its dilute composition. Studies of different mixture ratios of detergent composition to water have found a 2:1 ratio provides relevant modeling of its dissolution-viscosity behavior, which may be measured by large increases in viscosity. It has been noticed that when a specific system of rheology control agents is added in sufficient quantity, the viscosity behavior ceases to have the observed non-Newtonian shear thinning. Thus, a rheology control system changes the type of behavior (non-Newtonian to Newtonian) and prevents the multiple order of magnitude increase in viscosity observed without any rheology control agent. In the present formulations, the rheology modification system not only effectively prevents increases in viscosity of the formulation during dilution, but actually lowers viscosity of the formulation during dilution to make it easier for dissolution and use.

While not wishing to be bound by a particular theory, it appears that the basis of stability in the concentrated condition and the dilute (normal use) condition are different and that passing through the intermediate concentration places the formulation outside the regions of stability which define the behavior of the concentrated and dilute formulations. Adding a system of 3 or more particular rheology control agents helps to maintain a consistent, low viscosity profile to enhance hydration and dissolution profile.

It has been unexpectedly discovered that iminodisuccinic acid in combination with ethanol and polyethylene glycol, particularly PEG 400, shows synergistic results when used together as rheology control/modifying agents.

Detergent Composition

Rheology Modification System

It was previously determined by Applicant that polyglycol polymers may be used as rheology modifying agents in detergent compositions suitable for encapsulation in laundry pacs. In particular, about 2.5% to about 15 wt. %, more preferably about 5 to about 10 wt. %, most preferably about 6 to about 8 wt. %, of polyglycol, and particularly a polyethylene glycol, is able to maintain a consistent, low viscosity profile and to enhance hydration and dissolution profile of detergent compositions.

The combination of polyethylene glycol polyglycol with an alkoxylated polyamine, preferably a polyethyleneimine-ethoxylated (PEI-PO) polymer, was also found to produce detergent pac detergent compositions with low viscosity and good dissolution in water when PEG having a molecular weight of about 200 Daltons to about 1,000 Daltons was utilized. The combination was present in an amount from about 1 to about 15 weight percent of the detergent composition and the weight ration of PEG to PEI-PO polymer from about 10:1 to about 1:10.

However, it has been unexpectedly found by the present inventors that IDS has synergistic rheology modifying properties when combined with PEG and ethanol, that do not appear from the combination of PEG and EtOH, nor from the combination of IDS and PEG, nor from IDS and EtOH alone.

The rheology modification system of the present invention thus comprises IDS, ethanol and polyethylene glycol. In some embodiments, the rheology modification system or the detergent composition can additionally comprise an alkoxylated polyamine, such as a PEI-PO.

In certain embodiments, the rheology modification system consists essentially of polyethylene glycol, ethanol, and IDS. In certain other embodiments, the rheology modification system consists essentially of polyethylene glycol, ethanol, IDS and PEI-PO. Preferably, the rheology modification system consists of polyethylene glycol, ethanol, and IDS or polyethylene glycol, ethanol, IDS and PEI-PO.

The rheology modification system will typically be present in amount of about 1 to about 10% by weight of the detergent composition. In certain embodiments, the rheology modification system comprises about 2 to about 8% by weight of the detergent composition, most preferably, the rheology modification system comprises about 5 to about 8% by weight of the detergent composition.

Iminodisuccinic Acid (IDS)

Iminodisuccinic acid, CAS No. 131669-35-7, has the molecular formula $C_8H_{11}NO_8$. It is a chelant traditionally used in detergent compositions for stain removal. The present inventors have surprisingly found that when IDS is combined with PEG 400 and ethanol at certain concentrations, there is a synergistic effect on the rheology of liquid detergent compositions.

IDS is commonly supplied as a sodium or tetrasodium salt. As used herein, iminodisuccinic acid or IDS refers to both the free acid and its addition salts.

In certain embodiments, a sodium salt of iminodisuccinic acid is used.

IDS may be present in the detergent compositions from about 0.1% to about 1.0%, preferably about 0.15% to about 0.5%, more preferably about 0.2% to about 0.4% by weight of the detergent composition.

In certain preferred embodiments, IDS is present at about 0.2% by weight of the detergent composition. In other embodiments, IDS is present at about 0.33% by weight of the detergent composition.

Polyethylene Glycol (PEG)

Polyethylene glycol is a species of polyglycol homopolymer. Preferably, the PEG has a molecular weight between 200 and 1200 Daltons, preferably, 300 to 800 Daltons, and more preferably from 300 to 500 Daltons when used in the rheology modification system. Most preferably, the systems herein utilize polyethylene glycol having average molecular weight of 400 Daltons, i.e., PEG 400.

The PEG may be present in the rheology modification system from about 10% to about 99%, more preferably about 16 to about 98%, most preferably about 16.25 to about 97.2% by weight, based on the weight of the components of the rheology modification system (IDS, PEG, EtOH, PEI-PO). In certain preferred embodiments, the amount of PEG in the rheology modification system is about 50% by weight, more preferably 48.6% by weight based on the weight of the components of the rheology modification system (IDS, PEG, EtOH, PEI-PO). In come preferred embodiments, the amount of PEG is about 33%, more preferably about 32.4% by weight of the rheology modification system.

The PEG may be present in an amount from about 0.01 to about 7 wt. %, preferably, from about 1.0 to about 7.0 wt. %, of the detergent composition, and more preferably, from about 1.2 to about 4.7 wt. %, of the detergent composition.

In some embodiments, the PEG is included in the detergent composition with one more other polyglycols, such as propylene glycol and/or glycerine, and the total amount of polyglycol is about 10 to about 30 wt. % of the detergent composition; in other embodiments, the total amount of polyglycol is about 11 to about 27 wt. %, of the detergent composition. Preferably, the total amount of polyglycol is from about 15 to about 25 wt. % of the detergent composition.

Ethanol

Ethanol may be present in the rheology modification system from about 0% to about 75%, more preferably about 10 to about 70% or about 15% to about 65%, most preferably about 16.1 to about 64.8% by weight, based on the weight of the components of the rheology modification system (IDS, PEG, EtOH, PEI-PO). In certain preferred embodiments, the amount of ethanol in the rheology modification system is about 50% by weight, more preferably 48.6% by weight based on the weight of the components of the rheology modification system (IDS, PEG, EtOH, PEI-PO). In some preferred embodiments, the amount of ethanol is about 33%, more preferably about 32.4% by weight of the rheology modification system.

In some embodiments the ratio of EtOH:PEG in the rheology modification system is about 3:1 to about 1:3. In certain embodiments, the ratio of ethanol to polyethylene glycol in the rheology modification systems is at least about 1:1. In some of those embodiments, the ratio of ethanol to polyethylene glycol is about 1:1 to about 3:1. In certain preferred embodiments, the ratio of ethanol to polyethylene glycol is about 1.5:1.

Ethanol may be present in an amount from about 0.5% to about 6.0 wt. %, preferably, from about 1.0 to about 5.0 wt. %, of the detergent composition, and more preferably, from about 1.2 to about 4.7 wt. %, of the detergent composition.

Alkoxylated Polymer

Alkoxylated polymers are available with a variety of polymer backbones. In an embodiment, the polymer is formed with a polyamine backbone. An alkoxylated polymer may have between 10 and 25 polyglycol repeat units per mer unit of the polymer.

A polyethyleneimine-ethoxylated polymer (PEI-PO) used in accordance with the present disclosure may include a polyethyleneimine backbone that has a weight average molecular weight of from about 400 Daltons to about 10,000 Daltons, for example from about 400 Daltons to about 6,000 Daltons, such as from about 400 Daltons to about 1,800 Daltons. The substitution of the polyethyleneimine backbone may include one or two ethoxylation modifications per nitrogen atom, dependent on whether the modification occurs at an internal nitrogen atom or at a terminal nitrogen atom in the polyethyleneimine backbone. The ethoxylation modification may consists of the replacement of a hydrogen atom by a polyoxyethylene chain having an average of about 40 to about 90 ethoxy units per modification, for example about 45 to about 80 ethoxy units, such as about 50 to about 80 ethoxy units.

PEI-PO may be present in the rheology modification system or the detergent composition from about 0% to about 70%, more preferably about 10 to about 65%, most preferably about 16.25 to about 64.9% by weight, based on the weight of the components of the rheology modification system (IDS, PEG, EtOH, PEI-PO) or based on the total weight of the detergent composition. In certain preferred embodiments, the amount of PEI-PO is about 32% by weight of the rheology modification system, or about 1% by weight to about 7% by weight of the detergent composition. In certain preferred embodiments, PEI-PO is about 1% to about 5% by weight of the detergent composition.

In an embodiment, alkoxylated polyethyleneimine is about 0 to about 5.0 wt. % of the detergent composition, preferably, about 0.4 to about 4.7 wt. % of the detergent composition, more preferably about 1.2 to about 4.7 wt. % of the detergent composition, and most preferably about 1.2 to about 3.5 wt. % of the detergent composition.

The combination of iminodisuccinic acid, ethanol, and PEG 400 (with and without alkoxylated polyethyleneimine) has shown particularly useful results when used in detergent compositions that are encapsulated in unit dose pacs.

Unit dose detergent compositions may include a variety of components including but not limited to: surfactants (anionic, cationic, non-ionic, zwitterionic and/or amphoteric), humectants, non-aqueous solvents, water, builders, complexers, chelators, enzymes, foam stabilizers, colorants, colorant stabilizers, optical brighteners, whitening agents, bittering agents, perfumes, and other optional components.

Surfactants

Useful surfactants in the liquid compositions of the present invention include, for example, an anionic surfactant, a nonionic surfactant, a cationic surfactant, an ampholytic surfactant, a zwitterionic surfactant, and/or mixtures thereof. The use of multiple surfactants of a particular type or a distribution of different weights of a surfactant may be particularly useful. The categories of surfactants will be discussed individually, below.

Anionic Surfactants: Suitable anionic surfactants include but not limited to those surfactants that contain a long chain hydrocarbon hydrophobic group in their molecular structure and a hydrophilic group, i.e., water solubilizing group including salts such as carboxylate, sulfonate, sulfate, or phosphate groups. Suitable anionic surfactant salts include sodium, potassium, calcium, magnesium, barium, iron, ammonium and amine salts. Other suitable secondary anionic surfactants include the alkali metal, ammonium and alkanol ammonium salts of organic sulfuric reaction products having in their molecular structure an alkyl, or alkaryl group containing from 8 to 22 carbon atoms and a sulfonic or sulfuric acid ester group.

In one embodiment, the anionic surfactant is a polyethoxylated alcohol sulfate. Such materials, also known as alkyl-ether sulfates (AES) or alkyl polyethoxylate sulfates, are those which correspond to the following formula (I):

$$R'—O—(C_2H_4O)n\text{-}SO_3M' \quad (I)$$

wherein R' is a C8-C20 alkyl group, n is from 1 to 20, and M' is a salt-forming cation; preferably, R' is C10-C18 alkyl, n is from 1 to 15, and M' is sodium, potassium, ammonium, alkylammonium, or alkanolammonium. In an embodiment, R' is a C12-C16 alkyl, n is from 1 to 6 and M' is sodium. In one preferred embodiment, the alkylether sulfate has a C12 alkyl chain, for example, sodium lauryl ether sulphate (SLES).

The alkyl-ether sulfates will generally be used in the form of mixtures comprising varying R' chain lengths and varying degrees of ethoxylation. The heterogeneity of chain length may be due to the sourcing of the material and/or the processing of the material. Frequently such mixtures will inevitably also contain some unethoxylated alkyl sulfate materials, i.e., surfactants of the above ethoxylated alkyl sulfate formula wherein n=0. Unethoxylated alkyl sulfates may also be added separately to the liquid compositions of this invention. Suitable unalkoxylated, e.g., unethoxylated, alkyl-ether sulfate surfactants are those produced by the sulfation of higher C8-C20 fatty alcohols. Conventional primary alkyl sulfate surfactants have the general formula of: ROSO3M, wherein R is typically a linear C8-C20 hydrocarbyl group, which may be straight chain or branched chain, and M is a water-solubilizing cation; preferably R is a C10-C15 alkyl, and M is alkali metal. In one embodiment, R is C12-C14 and M is sodium. Examples of other anionic surfactants are disclosed in U.S. Pat. No. 6,284,230, the disclosure of which is incorporated by reference herein.

The anionic surfactant may include a water-soluble salt of an alkyl benzene sulfonate having between 8 and 22 carbon atoms in the alkyl group. In one embodiment, the anionic surfactant comprises an alkali metal salt of C10-16 alkyl benzene sulfonic acids, such as C11-14 alkyl benzene sulfonic acids. In one embodiment, the alkyl group is linear and such linear alkyl benzene sulfonates are known in the art as "LAS." Other suitable anionic surfactants include sodium and potassium linear, straight chain alkylbenzene sulfonates in which the average number of carbon atoms in the alkyl group is between 11 and 14. Sodium C11-C14, e.g., C12, LAS are exemplary of suitable anionic surfactants for use herein.

In one embodiment, the anionic surfactant includes at least one α-sulfofatty acid ester. Such a sulfofatty acid is typically formed by esterifying a carboxylic acid with an alkanol and then sulfonating the α-position of the resulting ester. The α-sulfofatty acid ester is typically of the following formula (II):

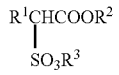

(II)

wherein R1 is a linear or branched alkyl, R2 is a linear or branched alkyl, and R3 is hydrogen, a halogen, a mono-valent or di-valent cation, or an unsubstituted or substituted ammonium cation. R1 can be a C4 to C24 alkyl, including a C10, C12, C14, C16 and/or C18 alkyl. R2 can be a C1 to C8 alkyl, including a methyl group. R3 is typically a mono-valent or di-valent cation, such as a cation that forms a water soluble salt with the α-sulfofatty acid ester (e.g., an alkali metal salt such as sodium, potassium or lithium). The α-sulfofatty acid ester of formula (II) can be a methyl ester sulfonate, such as a C16 methyl ester sulfonate, a C18 methyl ester sulfonate, or a mixture thereof. In another embodiment, the α-sulfofatty acid ester of formula (II) can be a methyl ester sulfonate, such as a mixture of C12-C18 methyl ester sulfonates.

More typically, the α-sulfofatty acid ester is a salt, such as a salt according to the following formula (III):

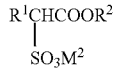

(III)

wherein R1 and R2 are linear or branched alkyls and M2 is a monovalent metal. R1 can be a C4 to C24 alkyl, including a C10, C12, C14, C16, and/or C18 alkyl. R2 can be a C1 to C8 alkyl, including a methyl group. M2 is typically an alkali metal, such as sodium or potassium. The α-sulfofatty acid ester of formula (III) can be a sodium methyl ester sulfonate, such as a sodium C8-C18 methyl ester sulfonate.

In one embodiment, the detergent composition contains about 5 wt. % to about 30 wt. % of one or more anionic surfactants, preferably about 8 wt. % to about 20 wt. %, more preferably about 10 wt. % to about 15 wt. %. In some embodiments, the anionic surfactant is provided in a solvent.

Nonionic Surfactants: Suitable nonionic surfactants include but not limited to alkoxylated fatty alcohols, ethylene oxide (EO)-propylene oxide (PO) block polymers, and amine oxide surfactants. Suitable for use in the liquid compositions herein are those nonionic surfactants which are normally liquid. Suitable nonionic surfactants for use herein include the alcohol alkoxylated nonionic surfactants. Alcohol alkoxylates are materials which correspond to the general formula of:

$$R_9(C_mH_{2m}O)_nOH,$$

wherein R9 is a linear or branched C8-C16 alkyl group, m is from 2 to 4, and n ranges from 2 to 12; alternatively, R9 is a linear or branched C9-15 or C10-14 alkyl group. In another embodiment, the alkoxylated fatty alcohols will be ethoxylated materials that contain from 2 to 12, or 3 to 10, ethylene oxide (EO) moieties per molecule. The alkoxylated fatty alcohol materials useful in the liquid compositions herein will frequently have a hydrophilic-lipophilic balance (HLB) which ranges from 3 to 17, from 6 to 15, or from 8 to 15. Another nonionic surfactant suitable for use includes ethylene oxide (EO)-propylene oxide (PO) block polymers, such as those marketed under the tradename Pluronic. These materials are formed by adding blocks of ethylene oxide moieties to the ends of polypropylene glycol chains to adjust the surface-active properties of the resulting block polymers.

In one embodiment, the nonionic surfactant is C12-C15 alcohol ethoxylate 7EO, that is to say having seven ethylene oxide moieties per molecule. The fatty alcohol ethoxylate may have 3 to 17 moles of ethylene oxide units per mole of fatty alcohol ethoxylate.

Another embodiment of a nonionic surfactant is alkoxylated, preferably ethoxylated or ethoxylated and propoxylated fatty acid alkyl esters, having from 1 to 4 carbon atoms in the alkyl chain, especially fatty acid methyl esters, as described, for example, in JP58/217598, which is incorporated by reference herein. In one embodiment, the nonionic surfactant is methyl ester ethoxylate.

Suitable nonionic surfactants also include polyalkoxylated alkanolamides, which are generally of the following formula (IV):

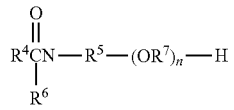

(IV)

wherein R4 is an alkyl or alkoxy, R5 and R7 are alkyls and n is a positive integer. R4 is typically an alkyl containing 6 to 22 carbon atoms. R5 is typically an alkyl containing 1-8 carbon atoms. R7 is typically an alkyl containing 1 to 4 carbon atoms, and more typically an ethyl group. The degree of polyalkoxylation (the molar ratio of the oxyalkyl groups per mole of alkanolamide) typically ranges from about 1 to about 100, or from about 3 to about 8, or about 5 to about 6. R6 can be hydrogen, an alkyl, an alkoxy group or a polyalkoxylated alkyl. The polyalkoxylated alkanolamide is typically a polyalkoxylated mono- or di-alkanolamide, such as a C16 and/or C18 ethoxylated monoalkanolamide, or an ethoxylated monoalkanolamide prepared from palm kernel oil or coconut oil. The use of coconut oil, palm oil, and similar naturally occurring oils as precursors may be favored by consumers.

Other suitable nonionic surfactants include those containing an organic hydrophobic group and a hydrophilic group that is a reaction product of a solubilizing group (such as a carboxylate, hydroxyl, amido or amino group) with an alkylating agent, such as ethylene oxide, propylene oxide, or a polyhydration product thereof (such as polyethylene glycol). Such nonionic surfactants include, for example, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, and alkylamine oxides. Other suitable surfactants include those disclosed in U.S. Pat. Nos. 5,945,394 and 6,046,149, the disclosures of which are incorporated herein by reference. In another embodiment, the composition is substantially free of nonylphenol nonionic surfactants. In this context, the term "substantially free" means less than about one weight percent.

Yet another nonionic surfactant useful herein comprises amine oxide surfactants. Amine oxides are often referred to in the art as "semi-polar" nonionics, and have the following formula (V):

$$R_{10}(EO)_x(PO)_y(BO)_zN(O)(CH_2R_{11})_2 \cdot qH_2O \quad (V)$$

wherein R10 is a hydrocarbyl moiety which can be saturated or unsaturated, linear or branched, and can typically contain from 8 to 24, from 10 to 16 carbon atoms, or a C12-C16 primary alkyl. R11 is a short-chain moiety such as a hydrogen, methyl and —CH2OH. When x+y+z is greater than 0, EO is ethyleneoxy, PO is propyleneoxy and BO is butyleneoxy. In this formula, q is the number of water molecules in the surfactant. In one embodiment, the nonionic surfactant is C2-14 alkyldimethyl amine oxide.

In one embodiment, the detergent composition includes about 15 wt. % to about 40 wt. % of one or more nonionic surfactants, preferably about 18 wt. % to about 30 wt. %, more preferably about 20 wt. % to about 25 wt. %.

Zwitterionic and/or Amphoteric Surfactants: Suitable zwitterionic and/or amphoteric surfactants include but not limited to derivatives of secondary and tertiary amines, derivatives of heterocyclic secondary and tertiary amines, or derivatives of quaternary ammonium, quaternary phosphonium or tertiary sulfonium compounds, such as those disclosed in U.S. Pat. No. 3,929,678, which is incorporated by reference herein.

Suitable zwitterionic and/or amphoteric surfactants for uses herein include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group. When present, zwitterionic and/or amphoteric surfactants typically constitute from 0.01 wt. % to 20 wt. %, preferably, from 0.5 wt. % to 10 wt. %, and most preferably 2 wt. % to 5 wt. % of the formulation by weight.

Cationic Surfactants: Suitable cationic surfactants include but not limited to quaternary ammonium surfactants. Suitable quaternary ammonium surfactants include mono C6-C16, or C6-C10 N-alkyl or alkenyl ammonium surfactants, wherein the remaining N positions are substituted by, e.g., methyl, hydroxyethyl or hydroxypropyl groups. Another cationic surfactant is C6-C18 alkyl or alkenyl ester of a quaternary ammonium alcohol, such as quaternary chlorine esters. In another embodiment, the cationic surfactants have the following formula (VI):

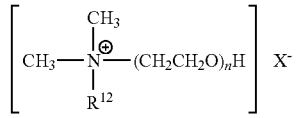

(VI)

wherein R12 is C8-C18 hydrocarbyl and mixtures thereof, or C8-14 alkyl, or C8, C10, or C12 alkyl, X is an anion such as chloride or bromide, and n is a positive integer.

In one embodiment, the surfactant of the liquid composition of the invention comprises an anionic surfactant, a nonionic surfactant, or mixtures thereof.

In another embodiment, the anionic surfactant is alkyl benzene sulfonic acid, methyl ester sulfate, sodium lauryl ether sulfate, or mixtures thereof. In another embodiment, the nonionic surfactant is alcohol ethoxylate, methyl ester ethoxylate, or mixtures thereof.

The surfactants may be a mixture of at least one anionic and at least one nonionic surfactant. In another embodiment, the anionic surfactant is sodium lauryl ether sulfate. In another embodiment, the surfactant is a mixture of at least two anionic surfactants. In one embodiment, the surfactant comprises a mixture of an alkyl benzene sulfonate and an alkyl-ether sulfate. In another embodiment, and the alkyl-ether sulfate is sodium lauryl ether sulphate (SLES).

In certain embodiments, the surfactant comprises about 15 wt. % to about 30 wt. % of an anionic surfactant selected from the group consisting of alkyl benzene sulfonate, methyl ester sulfonate, sodium lauryl ether sulphate, and mixtures thereof, and about 15 wt. % to about 30 wt. % of a nonionic surfactant selected from the group consisting of alcohol ethoxylate, methyl ester ethoxylate, and mixtures thereof.

Surfactants may collectively total more than 30 wt. % of the formulation. Surfactants are often the base of detergent compositions, however, other components, such as solvents and humectants may be used to make a liquid formulation rather than a solid formulation.

In an embodiment, the unit dose detergent composition includes an alkylether sulfate, a linear alkylbenze sulfonate, and a fatty alcohol ethoxylate. These three materials may collectively make up no less than 30% of the formulation.

In an embodiment, an alkyl-ether sulfate makes up 5 wt. % to about 30 wt. %, preferably about 8 wt. % to about 20 wt. %, and more preferably about 10 wt. % to about 15 wt. % of the detergent composition. A fatty alcohol ethoxylate may makes up about 15 wt. % to about 40 wt., preferably about 18 wt. % to about 30 wt. %, and more preferably about 20 wt. % to about 25 wt. % of the detergent composition. A linear alkyl benzene sulfonate may make up about 1 wt. % to about 12 wt. %, preferably about 2 wt. % to about 8 wt. %, and most preferably, about 4 wt. % to about 6 wt. % of the detergent composition. In some preferred embodiments, the alkyl-ether sulfate, the linear alkyl benzene sulfonate, and the fatty alcohol ethoxylate may be present in a ratio of (2 to 5):1:(3 to 10); preferably in a ratio of (2.5 to 3.5):1:(4 to 6); and most preferably in a ratio of approximately 3:1:5.

Non-Aqueous Solvents

Besides the non-aqueous solvent combination of ethanol, PEG and PEI-EO polymers described above in the rheology modification system, the detergent composition may optionally include other non-aqueous solvents. For example, other non-aqueous solvents that may be included in the detergent composition are glycerol, propylene glycol, ethylene glycol, and 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; sorbitol; tetramethylene glycol; butylene glycol; pentanediol; hexylene glycol; heptylene glycol; octylene glycol; 2-methyl, 1,3 propanediol; xylitol; mannitol; erythritol; dulcitol; inositol; adonitol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a number average molecular weight of 3,500 Daltons or less; and ethoxylated fatty acids. These optional non-aqueous solvents may be included in amounts, individually, of anywhere from about 1 weight percent to about 30 weight percent.

The detergent composition may include other components as well. For example, water is included in the detergent composition. In some embodiments, water is present in an amount of from about 5 to about 40 weight percent, from about 8 to about 30 weight percent, from about 10 to about 25 weight percent, or from about 12 to about 20 weight percent. In other embodiments, water is present in an amount of from about 5 to about 8 weight percent, from about 8 to about 11 weight percent, from about 11 to about 15 weight percent, or from about 15 to about 20 weight percent. Preferably, water is present at less than 20 percent by weight of the detergent composition. Water may be added to the detergent composition directly or as a component of other ingredients, or directly and as a component of other ingredients.

Humectants

A humectant, for purposes of the present invention, is a substance that exhibits high affinity for water, especially attracting water for moisturization and solubilization purposes. The water is absorbed into the humectant; not merely adsorbed at a surface layer. The water absorbed by the humectant is available to the system; the water is not too tightly bound to the humectant. For example, in a skin lotion, the humectant attracts moisture from the surrounding atmosphere while reducing transepidermal water loss, and makes the water available to the skin barrier. Similarly, the humectant in a single dose liquid formula will not trap all the water needed for solubilization of other formula components—it will help to maintain the water balance between the formula, the film, and the atmosphere.

Humectants possess hydrophilic groups which form hydrogen bonds with water. Common hydrophilic groups include hydroxyl, carboxyl, ester, and amine functionalities. A humectant can thus act as a solubilizer and moisture regulator in a unit dose formulation.

Useful humectants include but not limited to polyols. The polyol (or polyhydric alcohol) may be a linear or branched alcohol with two or more hydroxyl groups. Thus, diols with two hydroxyl groups attached to separate carbon atoms in an aliphatic chain may also be used. The polyol typically includes less than 9 carbon atoms, such as 9, 8, 7, 6, 5, 4, 3, or 2 carbon atoms. Preferably, the polyol includes 3 to 8 carbon atoms. More preferably, the polyol includes 3 to 6 carbon atoms. The molecular weight is typically less than 500 g/mol, such as less than 400 g/mol or less than 300 g/mol.

Embodiments of suitable polyols include, but not limited to: propylene glycol, butylene glycol, pentylene glycol, hexylene glycol, heptylene glycol, octylene glycol, 2-methyl-1,3-propanediol, xylitol, sorbitol, mannitol, diethylene glycol, triethylene glycol, glycerol, erythritol, dulcitol, inositol, and adonitol.

The unit dose detergent compositions of the present invention may contain about 5 wt. % to about 75 wt. % of one or more humectants, preferably about 7 wt. % to about 50 w.t %, more preferably about 10 wt. % to about 40 wt. %. In one preferred embodiment, the liquid composition comprises 20 to 30 wt. % of one or more C2 to C5 polyols.

Preferably, the C2 to C5 polyols comprise a mixture of glycerine and propylene glycol, where the ratio of glycerine to propylene glycol is from 2:1 to 1:2.

The unit dose detergent compositions of the present invention may optionally comprise other ingredients that can typically be present in detergent products and/or personal care products to provide further benefits in terms of cleaning power, solubilization, appearance, fragrance, etc. Different groups of such materials are described below.

Water

Water functions as a solvent and viscosity modifier. Water may be present as no more than 30 wt. % of the unit dose detergent composition. Water may comprise no more than 25 wt. % of the unit dose detergent composition. Water may comprise no more than 20 wt. % of the unit dose detergent composition.

Builders

Other suitable components include organic or inorganic detergency builders. Examples of water-soluble inorganic builders that can be used, either alone or in combination with themselves or with organic alkaline sequestrant builder salts, are glycine, alkyl and alkenyl succinates, alkali metal carbonates, alkali metal bicarbonates, phosphates, polyphosphates and silicates. Specific examples of such salts are sodium tripolyphosphate, sodium carbonate, potassium carbonate, sodium bicarbonate, potassium bicarbonate, sodium pyrophosphate and potassium pyrophosphate. Examples of organic builder salts that can be used alone, or in combination with each other, or with the preceding inorganic alkaline builder salts, are alkali metal polycarboxylates, water-soluble citrates such as sodium and potassium citrate, sodium and potassium tartrate, sodium and potassium ethylenediaminetetracetate (EDTA), sodium and potassium N(2-hydroxyethyl)-nitrilo triacetates, sodium and potassium N-(2-hydroxyethyl)-nitrilo diacetates, sodium and potassium oxydisuccinates, and sodium and potassium tartrate mono- and disuccinates, such as those described in U.S. Pat. No. 4,663,071, the disclosure of which is incorporated herein by reference.

Complexer/Chelator

Complexer and chelators help washing liquids support higher amounts of soils and/or metal ions. Complexer and/or chelators may functionally overlap with builders as discussed above. These are often poly carboxylic acids and/or salts thereof. Polyamines also may be used in this role. Suitable examples include iminodisuccinic acid, succinic acid, citric acid, ethylenediaminetetraacetic acid, etc. A complexer and/or chelator may make up about 0 to about 5 wt. % of the formulation, preferably about 0.1 to about 3 wt. % of the formulation, and most preferably about 0.5 to about 2 wt. % of the detergent composition.

Enzymes

Suitable enzymes include those known in the art, such as amylolytic, proteolytic, cellulolytic or lipolytic type, and those listed in U.S. Pat. No. 5,958,864, the disclosure of which is incorporated herein by reference. One protease is a subtillase from *Bacillus lentus*. Other suitable enzymes include proteases, amylases, lipases and cellulases.

Additional enzymes of these classes suitable for use in accordance with the present invention will be well-known to those of ordinary skill in the art, and are available from a variety of commercial suppliers. Enzymes maybe provided with other components, including stabilizers. In an embodiment, the enzyme material may be approximately 10% by weight of active enzymes. The detergent composition may include about 0.01 to about 1.3 wt. %, preferably, 0.05 to 0.50 wt. %, and most preferably, about 0.08 to about 0.3 wt. % of active enzymes.

Foam Stabilizers

Foam stabilizing agents include, but not limited to, a polyalkoxylated alkanolamide, amide, amine oxide, betaine, sultaine, C8-C18 fatty alcohols, and those disclosed in U.S. Pat. No. 5,616,781, the disclosure of which is incorporated by reference herein. Foam stabilizing agents are used, for example, in amounts of about 1 wt. % to about 20 wt. %, and typically about 3. wt. % to about 5 wt. %. The composition can further include an auxiliary foam stabilizing surfactant, such as a fatty acid amide surfactant. Suitable fatty acid amides are C8-C20 alkanol amides, monoethanolamides, diethanolamides, and isopropanolamides.

Colorants

In some embodiments, the liquid composition does not contain a colorant. In some embodiments, the liquid composition contains one or more colorants. The colorant(s) can be, for example, polymers. The colorant(s) can be, for example, dyes. The colorant(s) can be, for example, water-soluble polymeric colorants. The colorant(s) can be, for example, water-soluble dyes. The colorant(s) can be, for example, colorants that are well-known in the art or commercially available from dye or chemical manufacturers. The color of the colorant(s) is not limited, and can be, for example, red, orange, yellow, blue, indigo, violet, or any combination thereof.

The colorant(s) can be, for example, one or more of Acid Blue 80, Acid Red 52, and Acid Violet 48. When the colorant(s) are selected from the group consisting of Acid Blue 80, Acid Red 52, and Acid Violet 48, the liquid composition, optionally, does not contain a colorant stabilizer. Surprisingly, it has been found that Acid Blue 80, Acid Red 52, and Acid Violet 48, do not display significant discoloration over time, and thus, can be used without (e.g., in the absence of) a colorant stabilizer.

The colorant may provide a secondary indicator of source for a user. The colorant may provide aesthetic or informational value. For example, the color of the detergent composition may be used to indicate a preferred water temperature (e.g., red for hot, blue for cold).

The total amount of the one or more colorant(s) that can be contained in the liquid composition, for example, can range from about 0.00001 wt. % to about 0.099 wt. %. The total amount of colorant(s) in the liquid composition can be, for example, about 0.0001 wt. %, about 0.001 wt. %, about 0.01 wt. %, about 0.05 wt. %, or about 0.08 wt. %.

Colorant Stabilizer(s)

In some embodiments, the liquid composition can optionally contain a colorant stabilizer. In some embodiments, the colorant stabilizer can be citric acid. The total amount of the optionally present colorant stabilizer(s) in the liquid composition can range, for example, from about 0.01 wt. % to about 5.0 wt. %. The total amount of the colorant stabilizer (s) in the liquid composition can be, for example, about 0.1 wt. %, about 1 wt. %, about 2 wt. %, about 3 wt. %, or about 4 wt. %.

Optical Brightener/Whitening Agents

Optical brighteners and/or whitening agents help washed material appear white, especially under florescent light. The particular whitening agent is not believed to be impactful to the shelf stability of the formulations. Whitening agents may be complex, polycyclic molecules.

Examples of whitening agents include: 4,4'-diamino-2,2'-stilbenedisulfonic acid and 2,5-bis(benzoxazol-2-yl)thiophene. The substitution of similar whitening agents and/or reasonable modifications of their concentration in the formulation should produce similar results. An optical brightener and/or whitening agent may make up about 0 to about 5 wt. % of the formulation, preferably about 0.1 to about 3 wt. % of the formulation, and most preferably about 0.5 to about 2 wt. % of the detergent composition.

Bittering Agent

Bittering agents may optionally be added to hinder accidental ingestion of the composition. Bittering agents are compositions that taste bad, so children and/or others are discouraged from accidental ingestion. Exemplary bittering agents include denatonium benzoate, aloin, and others. Bittering agents may be present in the composition at an amount of from about 0 to about 1 wt. %, preferably from about 0 to about 0.5 wt. %, and most preferably from about 0 to about 0.1 wt. %, based on the total weight of the detergent composition.

Perfumes

The liquid compositions of the invention may optionally include one or more perfumes or fragrances. As used herein, the term "perfume" is used in its ordinary sense to refer to and include any fragrant substance or mixture of substances including natural (obtained by extraction of flowers, herbs, leaves, roots, barks, wood, blossoms or plants), artificial (mixture of natural oils or oil constituents) and synthetically produced odoriferous substances. Typically, perfumes are complex mixtures of blends of various organic compounds such as alcohols, aldehydes, ethers, aromatic compounds and varying amounts of essential oils (e.g., terpenes) such as from 0 wt. % to 80 wt. %, usually from 1 wt. % to 70 wt. %, the essential oils themselves being volatile odoriferous compounds and also serving to dissolve the other components of the perfume. Suitable perfume ingredients include those disclosed in "Perfume and Flavour Chemicals (Aroma Chemicals)", published by Steffen Arctander (1969), which is incorporated herein by reference. Perfumes can be present from about 0.1 wt. % to about 10 wt. %, and preferably from about 0.5 wt. % to about 5 wt. % of the detergent composition.

Other Optional Ingredients

The liquid compositions may also contain one or more optional ingredients conventionally included in detergent compositions such as a pH buffering agent, a perfume carrier, a fluorescer, a hydrotrope, an antifoaming agent, an antiredeposition agent, a polyelectrolyte, an optical brightening agent, a pearlescer, an anti-shrinking agent, an anti-wrinkle agent, an anti-spotting agent, an anti-corrosion agent, a drape imparting agent, an anti-static agent, an ironing aids crystal growth inhibitor, an anti-oxidant, an anti-reducing agent, a dispersing agent, a defoamer, a bleaching catalyst, a bleaching agent, a bleach activator, an anticorrosion agent, a deodorizing agent, a color/texture rejuvenating agent, a soil releasing polymer, a preservative, and a mixture thereof. Examples and sources of suitable such components are well-known in the art and/or are described herein.

Water-Soluble Pouch

The unit dose detergent compositions of the present invention may be placed a water-soluble pouch. The water soluble pouch is made from a water-soluble material which dissolves, ruptures, disperses, or disintegrates upon contact with water, releasing thereby the liquid composition. In one embodiment, the water soluble pouch is made from a lower molecular weight water-soluble polyvinyl alcohol film-forming resin.

The water soluble pouch may be formed from a water soluble polymer selected from the group consisting of polyvinyl alcohol (PVA), polyvinyl pyrrolidone, polyalkylene oxide, polyacrylamide, poly acrylic acid, cellulose, cellulose ether, cellulose ester, cellulose amide, polyvinyl acetate, polycarboxylic acid and salt, polyaminoacid, polyamide, polyanhydride copolymer of maleic/acrylic acid, polysaccharide, natural gums, polyacrylate, water-soluble acrylate copolymer, methylcellulose, carboxymethylcellulose sodium, dextrin, ethylcellulose, hydroxyethyl cellulose, maltodextrin, polymethacrylate, polyvinyl alcohol copolymer, hydroxypropyl methyl cellulose (HPMC), and mixtures thereof.

Unit dose pouches and methods of manufacture thereof that are suitable for use with the compositions of the present invention include those described, for example, in U.S. Pat. Nos. 3,218,776; 4,776,455; 4,973,416; 6,479,448; 6,727,215; 6,878,679; 7,259,134; 7,282,472; 7,304,025; 7,329,441; 7,439,215; 7,464,519; 7,595,290; 8,551,929; the disclosures of all of which are incorporated herein by reference in their entireties. In some embodiments, the pouch is a water-soluble, single-chamber pouch, prepared from a water-soluble film. According to one such aspect of the invention, the single-chamber pouch is a formed, sealed pouch produced from a water-soluble polymer or film such as polyvinylalcohol (PVA) or a PVA film.

Preferred water soluble polymers for forming the pouch are polyvinyl alcohol (PVA) resins having a weight average molecular weight range of about 55,000 to 65,000 and a number average molecular weight range of about 27,000 to 33,000. Preferably, the film material will have a thickness of approximately 3 mil or 75 micrometers.

In various embodiments, the film is desirably strong, flexible, shock resistant, and non-tacky during storage at both high and low temperatures and high and low humidities. In one embodiment, the film is initially formed from polyvinyl acetate, and at least a portion of the acetate functional groups are hydrolyzed to produce alcohol groups. The film may include polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 micrometers (μm), or from about 45 to about 100 μm, or from about 75 to about 90 μm in various embodiments.

In some embodiments, the water soluble pouch further comprises a crosslinking agent. In some embodiments, the cross-linking agent is selected from the group consisting of formaldehyde, polyesters, epoxides, isocyanates, vinyl esters, urethanes, polyimides, acrylics with hydroxyl, carboxylic, isocyanate or activated ester groups, bis(methacryloxypropyl)tetramethylsiloxane (styrenes, methylmethacrylates), n-diazopyruvates, phenylboronic acids, cis-platin, divinylbenzene (styrenes, double bonds), polyamides, dialdehydes, triallyl cyanurates, N-(2-ethanesulfonylethyl) pyridinium halides, tetraalkyltitanates, titanates, borates, zirconates, or mixtures thereof. In one embodiment, the cross-linking agent is boric acid or a boric acid salt such as sodium borate.

In additional embodiments, the water-soluble container or film from which it is made can contain one or more additional components, agents or features, such as one or more perfumes or fragrances, one or more enzymes, one or more surfactants, one or more rinse agents, one or more dyes, one or more functional or aesthetic particles, and the like. Such components, agents or features can be incorporate into or on the film when it is manufactured, or are conveniently introduced onto the film during the process of manufacturing the liquid composition of the present invention, using methods that are known in the film-producing arts.

The water-soluble container (e.g., pouch) used in association with the present invention may be in any desirable shape and size and may be prepared in any suitable way, such as via molding, casting, extruding or blowing, and is then filled using an automated filling process. Examples of processes for producing and filling water-soluble pouches, suitable for use in accordance with the present invention, are described in U.S. Pat. Nos. 3,218,776; 3,453,779; 4,776,455; 5,699,653; 5,722,217; 6,037,319; 6,727,215; 6,878,679; 7,259,134; 7,282,472; 7,304,025; 7,329,441; 7,439,215; 7,464,519; and 7,595,290; the disclosures of all of which are incorporated herein by reference in their entireties. In preferred embodiments, the pouches are filled with the liquid composition of the present invention using the cavity filling approach described in U.S. Pat. Nos. 3,218,776 and 4,776,455. The machinery necessary for carrying out this process is commercially available, e.g., from Cloud Packaging Solutions (Des Plaines, Ill.; a division of Hearthside Food Solutions LLC).

EXAMPLES

Example 1: DOE w/0.2% IDS

A detergent base composition comprising a surfactant system, carrier and various adjunct agents was prepared as show in Table 1. Twenty experimental Test formulations were thereafter prepared by including 7% of various rheology modification system compositions into the base composition. Thirteen of the experimental compositions further included 0.2% active IDS (the IDS solution used in the compositions was 33% active). The composition of the rheology modification system for each formulation is shown in Table 2.

The formulations were backfilled with glycerine and water ensuring that the level of water was balanced in all twenty test formulations.

TABLE 1

Detergent Base Composition

| Component | Raw Water Activity (%) | Water Activity in Formula (%) | Wt. % | Wt. % in Test Formulation 1-26 (qs with glycerine/water) |
|---|---|---|---|---|
| Glycerine | 0.25 | 0.02 | 8.00 | 9.64 |
| C12-C15 Alcohol Ethoxylate 7EO | 0.20 | 0.06 | 23.07 | 27.80 |
| Propylene Glycol | 0.12 | 0.01 | 8.21 | 9.89 |
| Sodium Sulfite 15% | 84.10 | 1.35 | 1.33 | 1.61 |
| Monoethanolamine | 0.10 | 0.004 | 3.63 | 4.38 |
| Zeolite water | 100.00 | 2.41 | 2.00 | 2.41 |
| HLAS | 0.38 | 0.32 | 7.08 | 8.53 |
| Coconut Oil Fatty Acid | 0.00 | 0.00 | 10.00 | 12.04 |
| AES 70% Paste | 28.00 | 6.55 | 19.42 | 23.40 |
| Bittering Agent | 0.00 | 0.00 | 0.05 | 0.06 |
| Optical Brightener | 0.00 | 0.00 | 0.20 | 0.24 |
| Rheology Modification Solvents | | | 0.00 | 7.00 |
| IDS | | | 0.00 | **see Table 2 |
| | | Totals | 83.00 | |

TABLE 2

Rheology Modification System Compositions (7.0-7.2 wt. % active)

| No. | Solvents (wt. %) PEI-PO | EtOH | PEG400 | IDS (wt. %) |
|---|---|---|---|---|
| 1 | 0 | 0 | 7 | 0 |
| 2 | 7 | 0 | 0 | 0 |
| 3 | 0 | 7 | 0 | 0 |
| 4 | 0 | 3.5 | 3.5 | 0 |
| 5 | 3.5 | 0 | 3.5 | 0 |
| 6 | 3.5 | 3.5 | 0 | 0 |
| 7 | 2.33 | 2.33 | 2.33 | 0 |
| 8 | 1.17 | 1.17 | 4.67 | 0 |
| 9 | 4.67 | 1.17 | 1.17 | 0 |
| 10 | 1.17 | 4.67 | 1.17 | 0 |
| 11 | 0 | 0 | 7 | 0.2 |
| 12 | 7 | 0 | 0 | 0.2 |
| 13 | 0 | 7 | 0 | 0.2 |
| 14 | 0 | 3.5 | 3.5 | 0.2 |
| 15 | 3.5 | 0 | 3.5 | 0.2 |
| 16 | 3.5 | 3.5 | 0 | 0.2 |
| 17 | 2.33 | 2.33 | 2.33 | 0.2 |
| 18 | 1.17 | 1.17 | 4.67 | 0.2 |
| 19 | 4.67 | 1.17 | 1.17 | 0.2 |
| 20 | 1.17 | 4.67 | 1.17 | 0.2 |
| 21 | 0 | 4 | 3 | 0 |
| 22 | 0 | 4 | 3 | 0.2 |
| 23 | 0 | 3.5 | 3.5 | 0 |
| 24 | 0 | 3.5 | 3.5 | 0.2 |
| 25 | 0 | 3 | 4 | 0 |
| 26 | 0 | 3 | 4 | 0.2 |

Example 2: Rheology Testing

The viscosities of the formulations of Example 1 were measured with an AR2000-EX Rheometer. The shear rate increased from 0.41 to 10 l/s at 20° C. with a geometry cone of 40 mm, 1:59:49 (degree:min:sec), and a truncation gap of 52 microns.

TABLE 3

| Viscosity of Formulas 1-26 | |
|---|---|
| No. | 2:1 (Pa · s) |
| 1 | 0.70 |
| 2 | 0.66 |
| 3 | 2.62 |
| 4 | 2.79 |
| 5 | 0.68 |
| 6 | 0.50 |
| 7 | 0.55 |
| 8 | 0.63 |
| 9 | 0.57 |
| 10 | 0.57 |
| 11 | 0.66 |
| 12 | 0.58 |
| 13 | 1.54 |
| 14 | 0.63 |
| 15 | 0.59 |
| 16 | 0.44 |
| 17 | 0.47 |
| 18 | 0.58 |
| 19 | 0.54 |
| 20 | 0.40 |
| 21 | 2.12 |
| 22 | 0.61 |
| 23 | 1.86 |
| 24 | 0.52 |
| 25 | 1.57 |
| 26 | 0.59 |

Formula 11 relative to Formula 1 confirmed prior learnings that PEG400 alone is a viable rheology controller, but it does not seem to have any synergy with IDS (0.695 v. 0.6634). Formula 3 shows that EtOH alone is not sufficient to pass rheology (2.616) and Formula 13 shows that even though there may be synergy of EtOH with IDS (1.542), it is not sufficient to overcome the passing threshold.

What was surprising to the team was Formula 14. A combination of EtOH and PEG in Formula 4 produce a hard failure (2.788), while the inclusion of IDS to PEG and EtOH in Formula 14 gives a significant boost in rheology performance to the composition (0.626). This is surprising because we have seen that EtOH alone is insufficient, even if PEG in higher quantities is sufficient.

The effect of IDS on PEG and EtOH was surmised as:

A: On PEG=0.0316

B: On EtOH=1.074

C: On PEG+EtOH=2.162

The inventors would reasonably expect a Pa·s difference of 1.1056 if EtOH, PEG and IDS were all included in a composition (0.0316+1.074=1.1056). However, Formula 14 shows a difference of 2.162 Pa·s, suggesting a novel synergistic effect on rheology behavior (A+B<C).

Formulas 22 and 24 confirm the effect of IDS at varying levels of ethanol and PEG. The inclusion of IDS brought the EtOH/PEG combination of Formulas 21 and 23 out of a failed state into a clean pass in each instance. The differences in results were 1.506 and 1.3404, respectively; the effect of IDS was again greater than the expected additive effect (1.1056).

Example 3

IDS at 0.067% and 0.33 wt. % was added to the detergent base of TABLE 1. The Rheology Modification Solvents included 3.5% ethanol and 3.5% PEG 400. The formulation was backfilled with glycerine and water. The composition was diluted 2:1 with water and the viscosity was measured using a TA Discovery HR20 Rheometer with a 1 minute hold at 1.08 l/s after temperature/conditioning of Example 2.

Results

| No. | 2:1 (Pa · s) |
|---|---|
| 0.067% IDS | 8.1 |
| 0.33% IDS | 0.70 |

It will be appreciated that, within the principles described by this specification, a vast number of variations exist. It should also be appreciated that the embodiments described are only embodiments, and are not intended to limit the scope, applicability, or construction of the claims in any way.

What is claimed is:

1. A method for controlling rheology of a unit dose liquid detergent composition comprising:

providing the detergent composition comprising:

less than 20% water, a detergent surfactant, and a rheology modification system consisting of iminodisuccinic acid (IDS), ethanol, and polyethylene glycol having a molecular weight of 200 to 1,000 Daltons; and encapsulating the detergent composition in a pouch made of a water soluble film;

wherein a viscosity of a mixture of 2 parts of the detergent composition to 1 part water is maintained below 1,000 cp at 1.08 reciprocal seconds; and wherein the rheology modification system comprises about 1 to about 10 percent by weight of the detergent composition.

2. The method of claim 1, wherein the detergent composition further comprises an alkoxylated polyamine.

3. The method of claim 1, wherein the detergent surfactant comprises about 30 to about 70 percent by weight of the detergent composition.

4. The method of claim 1, wherein the detergent surfactant comprises an alkyl ether sulfonate, a linear alkylbenzene sulfonate, and a fatty alcohol ethoxylate.

5. The method of claim 1, wherein the IDS comprises about 0.1% to about 1.0% by weight of the detergent composition.

6. The method of claim 1, wherein the detergent composition further comprises glycerine.

7. A liquid detergent composition for a unit dose Pac. comprising:

less than 20% water, a detergent surfactant, and a rheology modification system consisting of iminodisuccinic acid (IDS), ethanol, and polyethylene glycol having a molecular weight of 200 to 1,000 Daltons, wherein a water-diluted viscosity of the detergent composition is less than 1 Pa·s (1,000 cP) at 1.08 reciprocal seconds when diluted with additional water at a weight ratio of wash composition to additional water of about 2; and wherein the rheology modification system comprises about 1 to about 10 percent by weight of the detergent composition.

8. The liquid detergent composition of claim 7, wherein the detergent surfactant comprises about 30 to about 70 percent by weight of the detergent composition.

9. The liquid detergent composition of claim 7, wherein the detergent surfactant comprises an alkyl ether sulfonate, a linear alkylbenzene sulfonate, and a fatty alcohol ethoxylate.

10. The liquid detergent composition of claim 7, wherein the rheology modification system comprises IDS, ethanol, and polyethylene glycol 400.

11. The liquid detergent composition of claim 7, wherein the detergent composition further comprises an alkoxylated polyamine.

12. The liquid detergent composition of claim 7, wherein the amount of IDS is about 0.1% to about 1.0% by weight of the detergent composition.

13. The liquid detergent composition of claim 7, wherein the detergent composition further comprises glycerine.

14. The liquid detergent composition of claim 7, wherein the glycerine is about 5% to about 10% by weight of the detergent composition.

15. A unit dose detergent composition comprising:

a unit dose pouch comprising water soluble film, a detergent composition encapsulated in the unit dose pouch, wherein the detergent composition comprises:

less than 20% water, about 30 to about 70 percent by weight detergent surfactant, and about 1 to about 10 percent by weight of a rheology modification system consisting of iminodisuccinic acid (IDS), ethanol, and polyethylene glycol having a molecular weight of 400 Daltons;

wherein a water-diluted viscosity of the detergent composition is less than 1 Pa·s (1,000 cP) at 1.08 reciprocal seconds when diluted with additional water at a weight ratio of the detergent composition to additional water of about 2.

16. The unit dose detergent composition of claim 15, wherein IDS comprises about 0.1% to about 1.0% by weight of the detergent composition, ethanol comprises about 0.5% to about 6.0 wt. % by weight of the detergent composition and polyethylene glycol comprises about 10 to about 30 wt. % of the detergent composition.

17. The unit dose detergent composition of claim 15, wherein the detergent composition further comprises an alkoxylated polyamine.

* * * * *